US012472996B2

(12) United States Patent
Zhang et al.

(10) Patent No.: US 12,472,996 B2
(45) Date of Patent: Nov. 18, 2025

(54) UNDERNEATH TYPE RAILWAY FREIGHT CAR BOGIE WHEELSET RADIAL DEVICE

(71) Applicant: CRRC MEISHAN CO., LTD., Sichuan (CN)

(72) Inventors: Rui Zhang, Sichuan (CN); Chang Wu, Sichuan (CN); Ji Zhu, Sichuan (CN); Yungui Wang, Sichuan (CN); Dong Li, Sichuan (CN); Xianfeng Zhang, Sichuan (CN); Hanjiang Luo, Sichuan (CN); Jun Liao, Sichuan (CN); Jiale Li, Sichuan (CN); Chengli Feng, Sichuan (CN); Jun Yang, Sichuan (CN); Guangcai Zhang, Sichuan (CN)

(73) Assignee: CRRC MEISHAN CO., LTD., Sichuan (CN)

( * ) Notice: Subject to any disclaimer, the term of this patent is extended or adjusted under 35 U.S.C. 154(b) by 775 days.

(21) Appl. No.: 17/757,029

(22) PCT Filed: Jul. 23, 2020

(86) PCT No.: PCT/CN2020/103906
§ 371 (c)(1),
(2) Date: Jun. 8, 2022

(87) PCT Pub. No.: WO2021/114680
PCT Pub. Date: Jun. 17, 2021

(65) Prior Publication Data

US 2023/0294746 A1 Sep. 21, 2023

(30) Foreign Application Priority Data

Dec. 13, 2019 (CN) ..... 201911281569.9

(51) Int. Cl.
*B61F 5/38* (2006.01)
*B61F 5/52* (2006.01)

(52) U.S. Cl.
CPC . *B61F 5/38* (2013.01); *B61F 5/52* (2013.01)

(58) Field of Classification Search
CPC ..... B61F 5/38; B61F 5/52
See application file for complete search history.

(56) References Cited

U.S. PATENT DOCUMENTS 4,537,138 A * 8/1985 Bullock ..... B61F 5/32 105/167
9,802,626 B2 * 10/2017 Deng ..... B61F 5/28
(Continued)

FOREIGN PATENT DOCUMENTS

CN 102730018 A * 10/2012 ..... B61F 5/04
CN 202624249 U 12/2012
(Continued)

*Primary Examiner* — Jason C Smith
(74) *Attorney, Agent, or Firm* — NKL Law; Allen Xue

(57) ABSTRACT

An underneath type railway freight car bogie wheelset radial device has front and rear subframes and two cross-arranged connecting rods that are pinned by round pin connectors. The subframe is a combination structure of the adapter and the lateral arm. The connecting rods are arranged under the bolster to form the underneath bogie wheelset radial structure. The height of the central plane of the connecting rod is lower than the height of the central plane of the subframe adapter surface. The adapter has an adapter surface forming an arc-shaped adapter structure and an adapter connecting arm integrated with the adapter surface structure and vertically arranged at one end of the adapter surface; the subframes are fixed to the adapter by the rivet assembly.

6 Claims, 6 Drawing Sheets

(56) References Cited

U.S. PATENT DOCUMENTS

| | | | | |
|---|---|---|---|---|
| 2023/0018010 | A1* | 1/2023 | Liao | B61F 5/305 |
| 2023/0294746 | A1* | 9/2023 | Zhang | B61F 5/32<br>105/167 |

FOREIGN PATENT DOCUMENTS

| | | | | | |
|---|---|---|---|---|---|
| CN | 103661464 | A | * | 3/2014 | |
| CN | 203651795 | U | | 6/2014 | |
| CN | 207550209 | U | | 6/2018 | |
| CN | 108501972 | A | * | 9/2018 | B61F 5/50 |
| CN | 108995672 | A | | 12/2018 | |
| CN | 110758446 | A | | 2/2020 | |
| CN | 211308584 | U | * | 8/2020 | B61F 5/32 |
| EP | 4063227 | A1 | * | 9/2022 | B61F 5/32 |
| WO | WO-2025050552 | A1 | * | 3/2025 | |

* cited by examiner

UNDERNEATH TYPE RAILWAY FREIGHT CAR BOGIE WHEELSET RADIAL DEVICE

TECHNICAL FIELD

The present invention relates to the technical field of railway transportation equipment, and more particularly to an underneath radial device of a subframe type radial bogie for railway freight cars.

BACKGROUND

The wheelset radial device of the existing railway freight car subframe radial bogie is generally composed of front and rear subframes and two cross-arranged connecting rods that are pinned by round pin connectors. The subframes are placed at both ends of the bolster, and the connecting rods pass through the hole in the center of the bolster. In order to meet the requirements of the lower limit of the freight car, reserve the arrangement space of other parts of the bogie, especially the foundation brake, reduce the design difficulty of the bolster, and ensure the compactness of the bolster structure, the subframe type radial bogie mainly uses a lower pull rod for lever brake.

With the continuous development of railway freight car technique, the application of integrated bogie brakes are increasingly expanded. Due to their inherent structural characteristics, the existing sub-frame type radial bogies have poor adaptability to integrated brakes and cannot be matched with some integrated brakes; meanwhile, as the connecting rods of the wheelset radial device pass through the hole in the center of the bolster, and the spatial structure of the two crosses, the bogie assembly is difficult and it is not conducive to maintenance and repair.

SUMMARY

The present invention discloses an underneath type railway freight car bogie wheelset radial device. The device is designed so that the connecting rods pass through the lower structure of the bogie below the bolster, the side frame, and the foundation brake. With a reasonable space structure and sufficient strength and rigidity, it can better adapt to integrated brakes, and the assembly and maintenance can be easily performed.

The present invention is realized by the following technical solution:

An underneath type railway freight car bogie wheelset radial device, having front and rear subframes and two cross-arranged connecting rods that are pinned by round pin connectors, characterized in that: the subframe is a combination structure of the adapter and the lateral arm; the connecting rods are arranged under the bolster to form the underneath bogie wheelset radial structure; the height of the central plane of the connecting rod is lower than the height of the central plane of the subframe adapter surface.

The height of the center plane of the connecting rod is the minimum vertical distance between the center of the geometric section of the connecting rod and the rail surface after the bogie is assembled, and the center height of the adapter surface is the vertical distance between the centerline of the adapter surface and the rail surface after the bogie is assembled.

The adapter has an adapter surface forming an arc-shaped adapter structure and an adapter connecting arm integrated with the adapter surface structure and vertically arranged at one end of the adapter surface; the adapter connecting arm is provided with multiple groups of adapter connecting holes and an adapter locking hole located at the center; a vertically structured lateral arm flange is provided at the end of the lateral arm, and the lateral arm flange is provided with multiple groups of lateral arm connecting holes corresponding to the adapter connecting holes and a lateral arm bolt located at the center; the subframe is formed by fixing the connecting holes of the adapter and the connecting holes of the lateral arm with the rivet assembly, and locking the lateral arm bolt passing through the locking hole of the adapter with a lock pin.

The adapter connecting holes and the lateral arm connecting holes are provided in three groups and arranged in a triangle.

The adapter connecting arm at one end of the adapter has a box-shaped section

The subframe is provided with a vertical adapter connecting arm, reasonable adapter connecting holes and a horizontally arranged lateral arm, so that the connecting rods are placed under the bolster as a whole, and good manufacturability of the overall structure is realized. The subframe is provided with an adapter connecting arm with a box-shaped section to ensure sufficient strength and rigidity under the action of the bending moment generated between the center of the adapter surface and the center plane of the connecting rods. The connecting rods are cross-arranged, and the ends are embedded in the mounting grooves of the subframe and connected by round pins.

A rigid bushing or an elastic hinge can be provided at each end of the connecting rods.

There is a small gap between the round pins and the subframes and the connecting rods and a rotational degree of freedom around the axis of the round pins.

Compared with general wheelset radial devices, the present invention has the following advantages:

1. It can better adapt to the traditional lever brakes and integrated brakes, effectively improving the versatility of the bogie and facilitating technical transformation and upgrade of the bogie.
2. The wheelset radial device does not cross other parts of the bogie in terms of spatial structure so that it can be assembled independently, and the assembly process of the bogie is simple and convenient.
3. The wheelset radial device and other parts of the bogie can be directly separated by removing the retaining key, without affecting the structure of other parts, effectively reducing the difficulty of maintenance.

Figure 1:
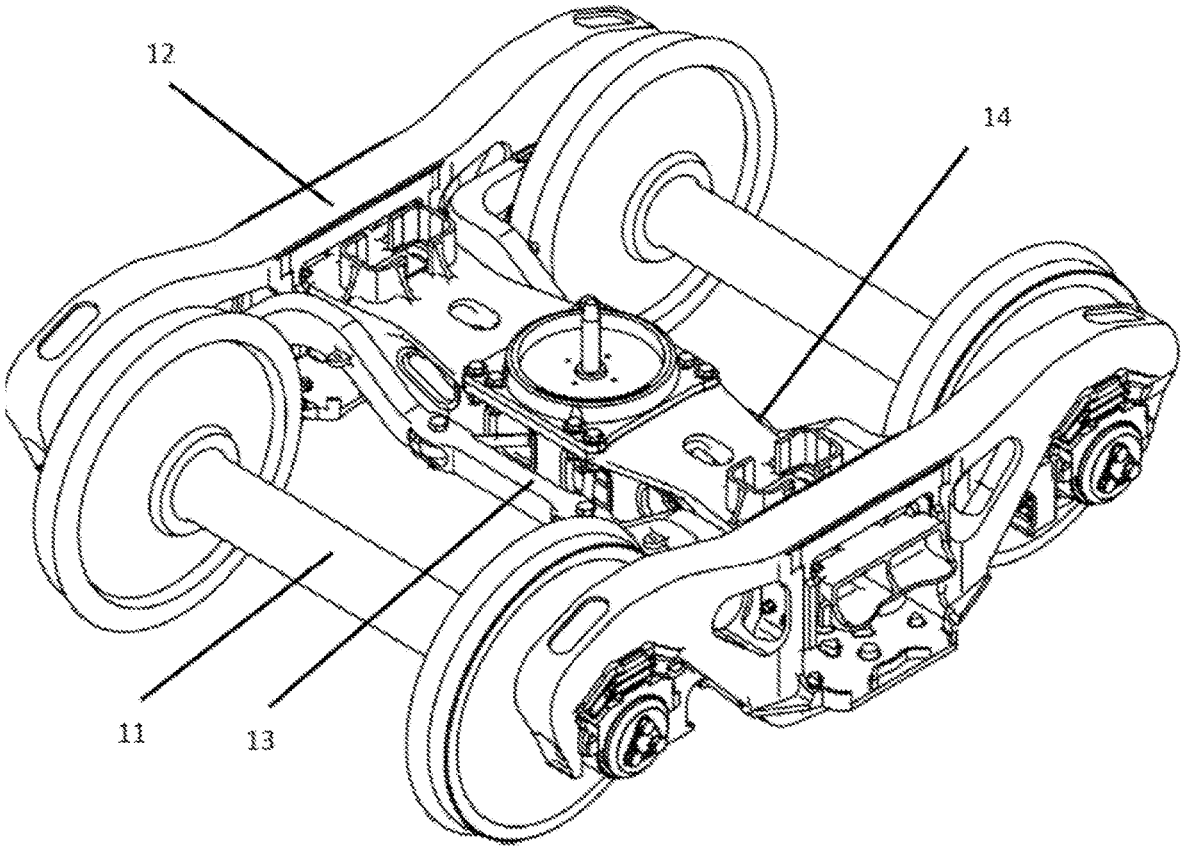
FIG. 1 is a schematic diagram of the isometric structure of an existing subframe radial bogie.

Reference numbers: 11—wheelset and bearing; 12—side frame; 13—wheelset radial device; 14—bolster; 21—existing subframe; 22—existing connecting rod; 23—existing connector; 21'—subframe; 22'—connecting rod; 23'—connector; 24'—mounting groove; 31—adapter; 311—adapter surface; 312—adapter connecting arm; 313—adapter connecting hole; 314—adapter locking hole; 32—lateral arm; 321—lateral arm flange; 322—lateral arm bolt; 323—lateral arm connecting hole; 33—rivet assembly.

DETAILED DESCRIPTION

The present invention is further described below in combination with specific embodiments which further illustrate principles of the present invention and do not limit the present invention in any way. The same or similar technologies as the present invention are not beyond the protection scope of the present invention.

Refer to the figures.

As shown in the figure, the underneath type railway freight car bogie wheelset radial device 13 of the present invention has front and rear subframes 21' and two cross-arranged connecting rods 22' that are pinned by round pin connectors 23'. The subframe 21' is a combination structure of the adapter 31 and the lateral arm 32; the connecting rods 22' are arranged under the bolster 14 to form the underneath bogie wheelset radial structure; the height of the central plane of the connecting rod 22' is lower than the height of the central plane of the subframe adapter 31 surface.

The adapter 31 has an adapter surface 311 forming an arc-shaped adapter structure and an adapter connecting arm integrated with the adapter surface 311 structure and vertically arranged at one end of the adapter surface 311; the adapter connecting arm 312 is provided with multiple groups of adapter connecting holes 313 and an adapter locking hole 314 located at the center; a vertically structured lateral arm flange 321 is assembled and welded at the end of the lateral arm 32, and the lateral arm flange 321 is provided with multiple groups of lateral arm connecting holes 313 corresponding to the adapter connecting holes 323 and a lateral arm bolt 322 located at the center; the subframe 21' is formed by fixing the connecting holes 313 of the adapter and the connecting holes 323 of the lateral arm with the rivet assembly 33, and locking the lateral arm bolt 322 passing through the locking hole 323 of the adapter with the lock pin.

The adapter connecting holes 313 and the lateral arm connecting holes 323 are provided in three groups and arranged in a triangle. The adapter connecting arm 312 at one end of the adapter 31 has a box-shaped section with sufficient strength and rigidity.

The wheelset radial device 13 of the present invention does not cross other parts of the bogie in terms of spatial structure and has a sufficient safety distance.

The connecting rods 22' are cross-arranged, and the ends are embedded in the mounting grooves 24' of the subframe 21' and connected by round pin connectors 23'; A rigid bushing or an elastic hinge can be provided at each end of the connecting rods 22'; There is a small gap between the round pin connectors 23' and the subframes 21' and the connecting rods 22' and a rotational degree of freedom around the axis of the round pins.

The present invention makes sufficient use of the lower space of the bogie by arranging the wheelset radial device 13 under the side frame, the bolster 14 and the foundation brake, which avoids the structural intersection of the wheelset radial device 13 and other parts of the bogie, reduces the design difficulty of the bolster 14, facilitates the arrangement of the foundation brake, and improves the versatility of the bogie.

Figure 3:
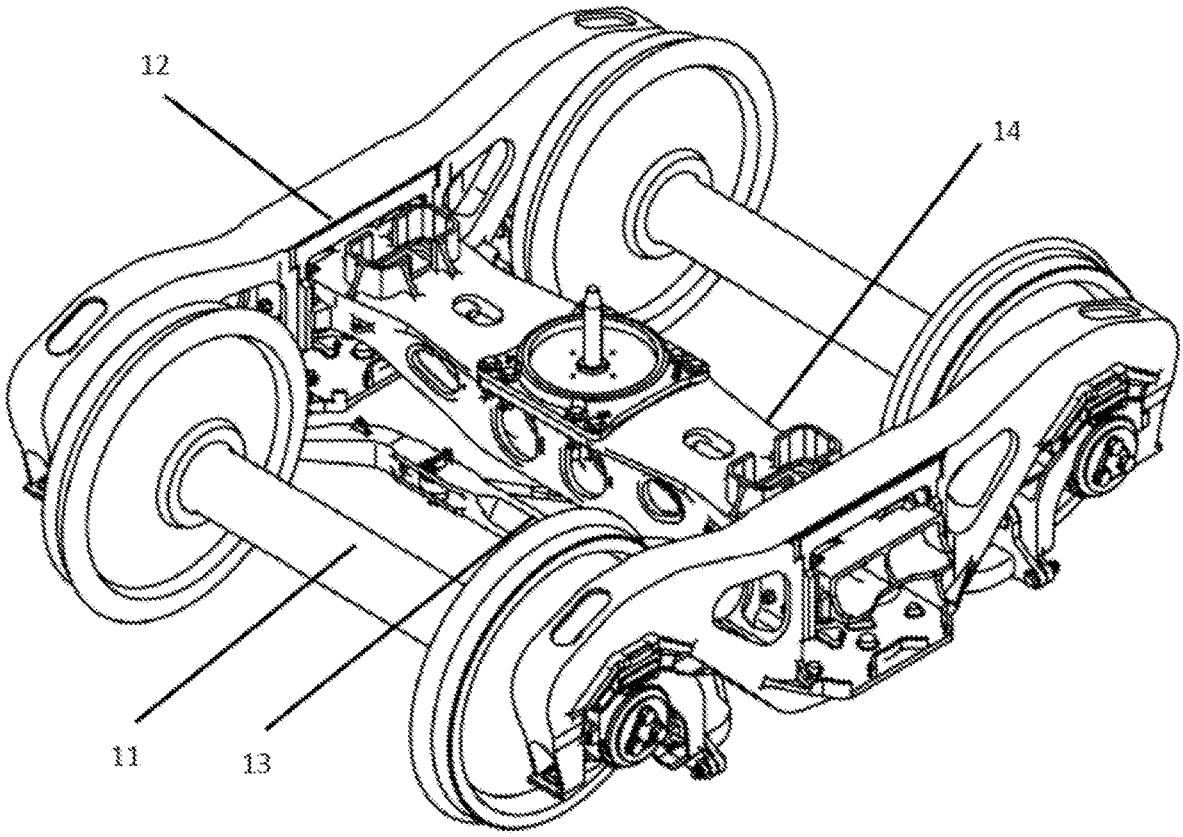
FIG. 3 is a schematic diagram of the isometric structure of a radial bogie using the present invention.
Figure 4:
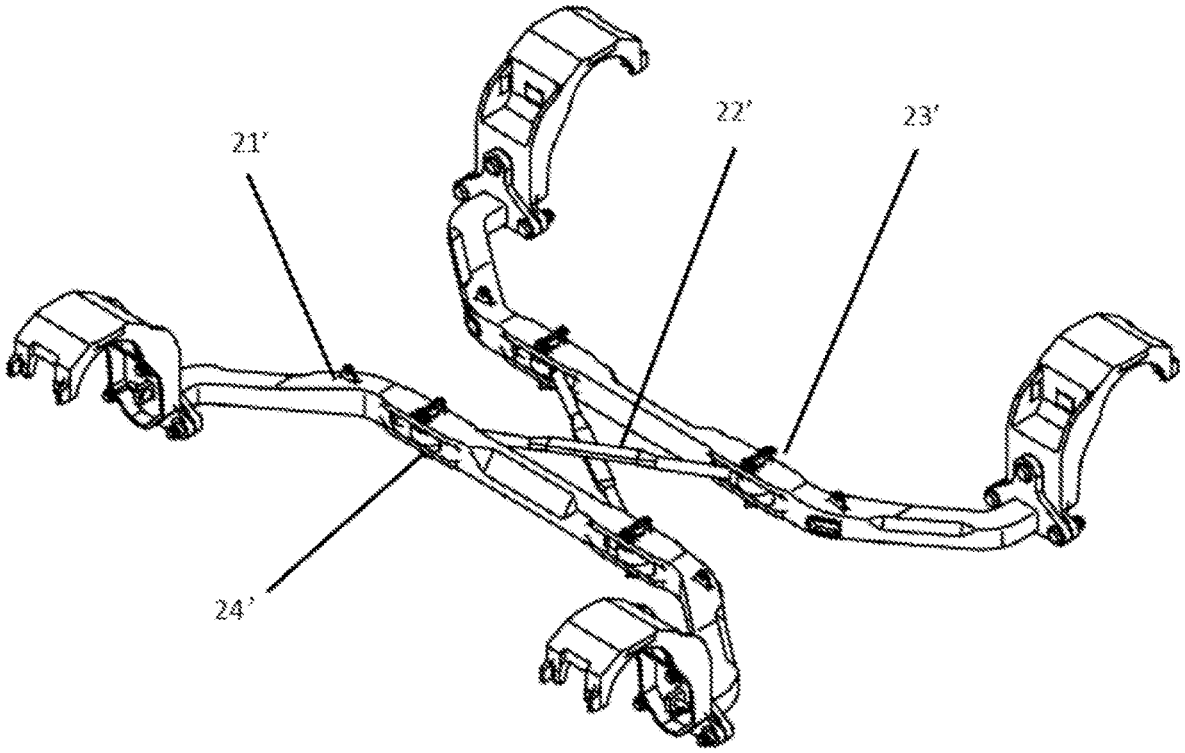
FIG. 4 is a schematic diagram of the axonometric structure of the radial device of the present invention.
Figure 5:
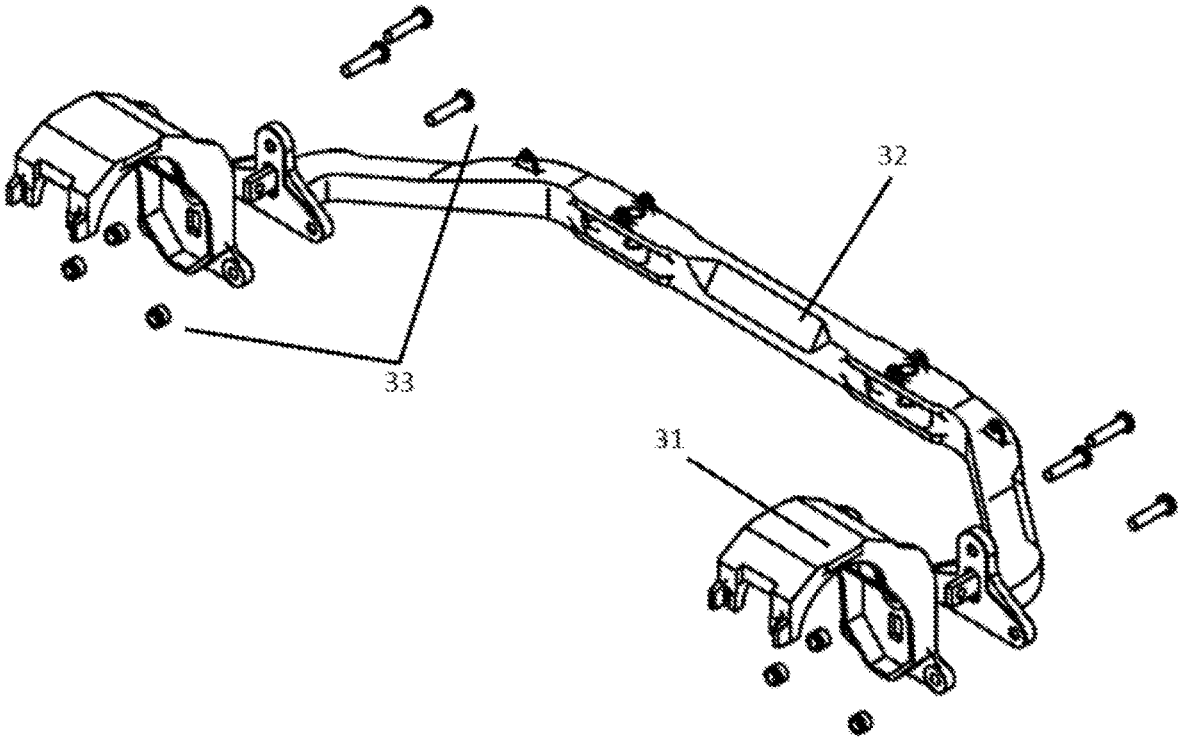
FIG. 5 is an exploded view of the subframe of the present invention.
Figure 6:
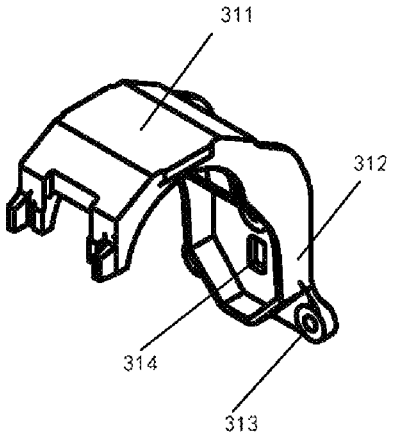
FIG. 6 is a schematic diagram of the adapter structure of the present invention.
Figure 7:
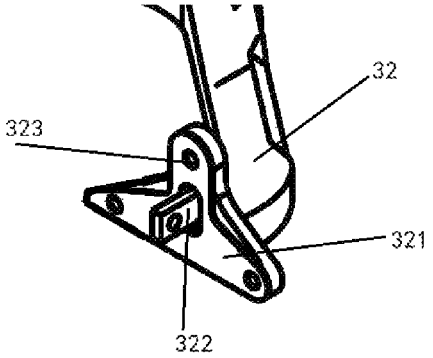
FIG. 7 is a schematic diagram of the structure of the lateral arm of the present invention.

As shown in FIGS. 3, 4 and 5, the underneath type railway freight car bogie wheelset radial device 13 of the present invention is composed of front and rear subframes 21' and two cross-arranged connecting rods 22' that are pinned by round pin connectors 23'. the subframe 21' is a combination structure of the adapter 31 and the lateral arm 32. There is a larger vertical span between the center of the adapter surface of the adapter 31 of the subframe 21' and the center plane of the connecting rods 22'; the connecting rods 22' are arranged under the bolster 14.

The wheelset radial device 13 does not cross other parts of the bogie in terms of spatial structure and has a sufficient safety distance.

The flange is provided at the connection part of the adapter 31 and the lateral arm 32, and is longitudinally connected by the high-strength rivet assembly 33; one end of the adapter 31 has a box-shaped section with sufficient strength and rigidity.

The connecting rods 22' are cross-arranged, and the ends are embedded in the mounting grooves 24' of the subframe 21' and connected by round pin connectors 23'. A rigid bushing or an elastic hinge can be provided at each end of the connecting rods 22'; There is a small gap between the round pin connectors 23' and the subframes 21' and the connecting rods 22' and a rotational degree of freedom around the axis of the round pins 23'.

FIG. 1 shows the structure of a general railway freight car subframe radial bogie, which is mainly composed of wheelset and bearing 11, side frame 12, wheel set radial device 13, bolster 14 and other components.

Figure 2:
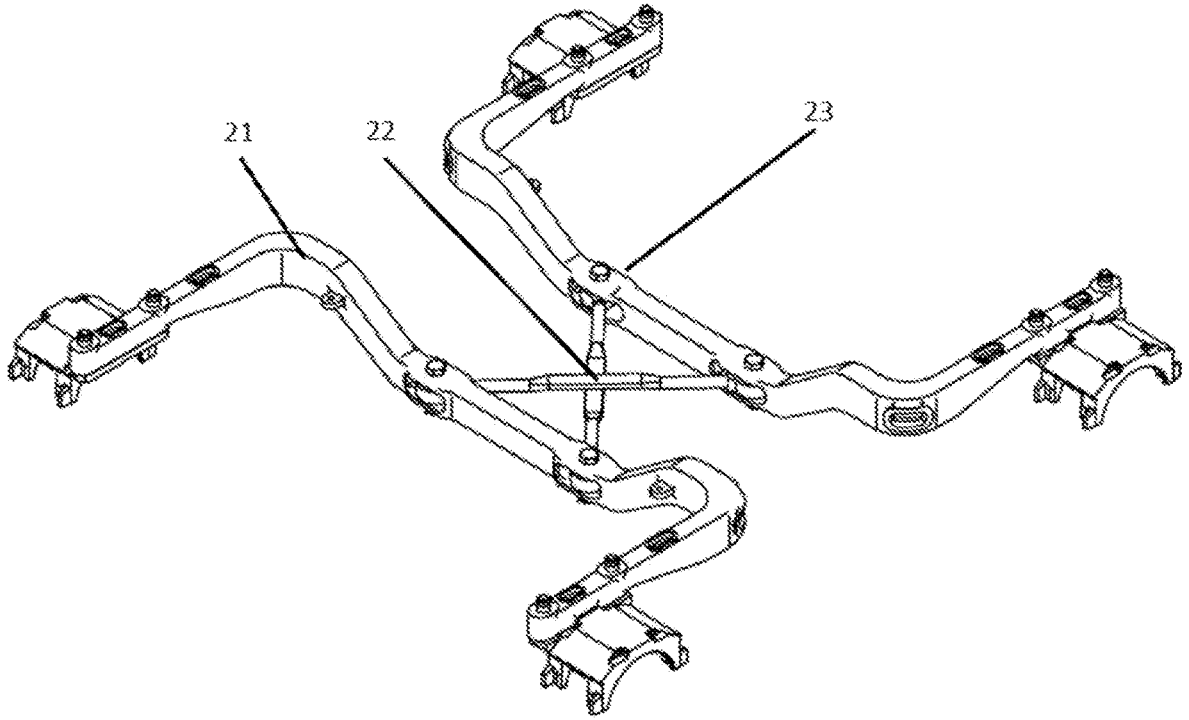
FIG. 2 is a schematic diagram of the isometric structure of an existing wheelset radial device.

FIG. 2 shows the structure of a general wheelset radial device 13, which is mainly composed of two subframes 21 and two connecting rods 22 that are pinned by round pin connectors 23. A rotational degree of freedom must be reserved during connection.

The invention claimed is:

1. An underneath type railway freight car bogie wheelset radial device adapted to integrated brakes and lever brakes, comprising:

a front subframe and a rear subframe and two cross-arranged connecting rods, each connecting rod has a first end and a second end pinned by round pin connectors to the front subframe and the rear subframe, respectively, wherein:

each subframe comprises an adapter and a lateral arm; each connecting rod is arranged under a bolster to form an underneath bogie wheelset radial structure;

the two connecting rods are disposed on a plane that is lower than a surface of the subframe adapter;

wherein the subframe adapter further comprises:

an adapter surface;

an adapter connecting arm integrated with the adapter surface and vertically arranged at one end of the adapter surface;

wherein the adapter connecting arm is provided with a plurality of adapter connecting holes and an adapter locking hole located at a center of the adapter surface;

wherein a vertically structured lateral arm flange is provided at an end of the lateral arm; the lateral arm flange is provided with a plurality of lateral arm connecting holes corresponding to the adapter connecting holes; and a lateral arm bolt located at the center;

each subframe is formed by fixing the connecting holes of the adapter and the connecting holes of the lateral arm with the rivet assembly, and locking the lateral arm bolt passing through the locking hole of the adapter with a lock pin.

2. The underneath type railway freight car bogie wheelset radial device according to claim 1, wherein the plurality of adapter connecting holes are provided in three groups and arranged in a triangle.

3. The underneath type railway freight car bogie wheelset radial device according to claim 2, wherein the adapter connecting arm at one end of the adapter includes a box-shaped section.

4. The underneath type railway freight car bogie wheelset radial device according to claim 3, wherein the connecting rods are cross-arranged, and the ends thereof are embedded in the mounting grooves of the subframe and connected by round pins.

5. The underneath type railway freight car bogie wheelset radial device according to claim 3, wherein a rigid bushing or an elastic hinge is provided at each end of each connecting rod.

6. The underneath type railway freight car bogie wheelset radial device according to claim 3, wherein there is a gap between the round pins and the subframes and the connecting rods and a rotational degree of freedom around the axis of the round pins.

* * * * *